US005163175A

United States Patent [19]

Mori et al.

[11] Patent Number: 5,163,175

[45] Date of Patent: Nov. 10, 1992

[54] SWITCH

[75] Inventors: Teijiro Mori; Tatsuya Hayashi, both of Hyogo; Masahiro Kakizoe, Aichi; Shigeharu Ohtsuka, Aichi; Shigeru Masuda, Aichi, all of Japan

[73] Assignee: Mitsubishi Denki Kabushiki Kaisha, Tokyo, Japan

[21] Appl. No.: 654,889

[22] Filed: Feb. 13, 1991

[30] Foreign Application Priority Data

| | | | |
|---|---|---|---|
| Feb. 14, 1990 | [JP] | Japan | 2-32956 |
| Feb. 28, 1990 | [JP] | Japan | 2-47840 |
| Mar. 13, 1990 | [JP] | Japan | 2-59988 |

[51] Int. Cl.[5] ..... H01H 67/02

[52] U.S. Cl. ..... 335/132; 335/172

[58] Field of Search ..... 335/78-85, 335/104, 128, 202, 6, 172, 132

[56] References Cited

U.S. PATENT DOCUMENTS

| | | | |
|---|---|---|---|
| 4,292,611 | 9/1981 | Bresson et al. | 335/6 |
| 4,307,358 | 12/1981 | Haury et al. . | |
| 4,470,028 | 9/1984 | Vayre et al. | 335/16 |
| 4,975,665 | 12/1990 | Ohishi et al. | 335/14 |

FOREIGN PATENT DOCUMENTS

| | | |
|---|---|---|
| 3713412 | 11/1988 | Fed. Rep. of Germany . |
| 63-36097 | 7/1988 | Japan . |

*Primary Examiner*—Lincoln Donovan

*Attorney, Agent, or Firm*—Burns, Doane, Swecker & Mathis

[57] ABSTRACT

A switch which is superior in current limiting performance. The switch comprises a movable contact element having a pair of movable contacts secured thereto, a pair of fixed contacts individually secured to fixed contact elements for individually contacting with the movable contacts, an electromagnetic driving device including a movable iron core, and a first operating rod secured to the movable iron core. An electromagnet is disposed alongside the electromagnetic driving device and includes a movable iron core, and movement of the movable iron core of the electromagnet is transmitted to the movable contact element by way of a transmitting member and a second operating rod. The first and second operating rods are disposed for movement along a common axial line, and movement of the movable iron core of the electromagnetic driving device is transmitted from the first operating rod to the movable contact element either directly or by way of the second operating rod.

14 Claims, 16 Drawing Sheets

SWITCH

BACKGROUND OF THE INVENTION

1. Field of the Invention

This invention relates to a switch having a function of switching load current and another function of limiting excessively high current such as short-circuit current.

2. Description of the Prior Art

Various switches of the type mentioned are conventionally known. An exemplary one of such conventional switches is disclosed, for example, in West German Patent Laid-Open Application No. 3713412 and shown in FIG. 16. Referring to FIG. 16, the switch shown includes an arc box 1 in which a movable contact element 2 is accommodated. A pair of movable contacts 3A and 3B are secured to the opposite end portions of the movable contact element 2 for contacting with a pair of fixed contacts 4A and 4B, respectively. The fixed contacts 4A and 4B are secured to a pair of fixed contacts elements 5A and 5B, respectively, which are, in turn, secured to a pair of bases 6A and 6B by means of screws not shown, respectively.

The arc box 1 has a guide 7 fixedly mounted in the inside thereof and further includes a second operating rod 8 having a first portion 8A fitted for vertical movement in the guide 7 and a second portion 8B integrally formed at and extending laterally from a lower end of the first portion 8A. The movable contact element 2 is located at the other or upper end of the first portion 8A of the second operating rod 8, and the movable contact element 2 and second operating rod 8 are normally urged downwardly by a first spring 9 fitted in the guide 7. A pair of sets or arc-extinguishing plates 11A and 11B made of a magnetic metal material are disposed on the opposite sides of the movable contact element 2 for extinguishing arcs 10A and 10B which may be produced between the movable contacts 3A and 3B and fixed contact elements 4A and 4B, respectively.

An operating mechanism box 12 is secured to the bottom of the arc box 1 and has an electromagnet 13 accommodated therein. The electromagnet 13 includes a fixed iron core 13A, a movable iron core 13B and a coil 13C. A first transmitting member 14 is secured to the movable iron core 13B of the electromagnet 13. A second transmitting member 15 is supported for pivotal motion around a fixed shaft 15A and normally urged at an end portion thereof by a second spring 16 so that the end portion thereof is held in contact with a top end of the first transmitting member 14 while the other end portion thereof is held in contact with a lower face of the second portion 8B of the second operating rod 8.

An electromagnetic driving device 17 is located in the operating mechanism box 12 and includes a fixed iron core 17A, a movable iron core 17B, a coil 17C, a biasing spring 17D and a first operating rod 17E. The opposite ends of the coil 17C are electrically connected to the first fixed contact 5A and a first terminal 18A by way of a pair of first and second lead wires or conductors 19A and 19B, respectively. A second terminal 18B is electrically connected to the second contact 5B.

In operation, when the coil 13C of the electromagnet 13 is energized, the movable iron core 13B of the electromagnet 13 is attracted to the fixed iron core 13A to move the first transmitting member 14 secured thereto upwardly. Thereupon, the second transmitting member 15 is pivoted in the counterclockwise direction in FIG. 16 around the fixed shaft 15A by the first transmitting member 14 to such a position as shown in FIG. 17. Consequently, the movable contact element 2 and second operating rod 8 are moved down by the urging force of the first spring 9 under the guidance of the guide 7. As a result, the movable contacts 3A and 3B on the movable contact element 2 are contacted with the fixed contacts 4A and 4B, respectively, as seen in FIG. 17 to allow load current to flow between the first and second terminals 18A and 18B by way of the movable contact element 2. Such load current also flows through the coil 17C of the electromagnetic driving device 17.

Then, when the coil 13C of the electromagnet 13 is deenergized, the first and second transmitting members 14 and 15, movable iron core 13B of the electromagnet 13, second operating rod 8 and movable contact element 2 are returned to their respective home positions shown in FIG. 16 by the urging force of the second spring 16. Upon upward movement of the movable contact element 2 then, arcs 10A and 10B may be produced between the movable contacts 3A and 3B and fixed contacts 4A and 4B, respectively. The arcs 10A and 10B are attracted to and deformed by the magnetic metal arc-extinguishing plates 11A and 11B as indicated at 10C and 10D, respectively. Such arcs 10C and 10D are cooled by the metal arc-extinguishing plates 11A and 11B, and consequently, they are extinguished at a zero point of ac current.

If a short-circuit accident happens in such condition of the switch as shown in FIG. 17, then high current will flow through the coil 17C of the electromagnetic driving device 17. Consequently, the movable iron core 17B of the electromagnetic driving device 17 is attracted to the fixed iron core 17A to move the first operating rod 17E upwardly to such a position as shown in FIG. 18. Accordingly, the second operating rod 8 and movable contact 2 are moved upwardly by the first operating rod 17E. As a result, arcs 10A and 10B may be produced between the movable contacts 3A and 3B and fixed contacts 4A and 4B, respectively. Also in this instance, the arcs 10A and 10B are attracted to and deformed or elongated by the magnetic metal arc-extinguishing plates 11A and 11B into such arcs as indicated at 10C and 10D in FIG. 16. Consequently, the resistance, of the arcs increase, and as a result, the short-circuit current is limited. Such short-circuit current is interrupted by a breaker not shown.

While conventional switch is constructed and operates in such a manner as described above, since the second operating rod 8 is disposed in a spaced relationship over a significantly great distance from an axial line X-Y of the first operating rod 17E, the second operating rod 8 may be moved up in an inclined condition in the guide 7 as seen in FIG. 18. In this instance, a great frictional force is produced between the second operating rod 8 and guide 7 and will retard the upward movement of the second operating rod 8 thereby to lower the speed of separating movement of the movable contacts 3A and 3B from the respective fixed contacts 4A and 4B. Here, if it is assumed that the short-circuit current then is, for example, 100 kA in effective value, then the rising rate of the short-circuit current is very high at $5.3\times107$ A/sec, and accordingly, the short-circuit current increases suddenly. Accordingly, even if the movement of the second operating rod 8 is retarded only by 1/1,1000 second, the short-circuit current will increase by 53 kA. Therefore, a breaker connected in series to the switch is required to have a high interrupting capacity. Further, since the arc energy in the switch is very high, possible damage to the switch may be very serious. Besides, the amount of conductive hot gas to be discharged from the switch is increased by such high arc energy and may cause a ground-fault accident or may likely hurt a human body. In addition, the internal pressure of the switch may be increased to damage or destroy the switch.

SUMMARY OF THE INVENTION

It is an object of the present invention to provide a switch which is superior in current limiting performance.

In order to attain the object, according to one aspect of the present invention, there is provided a switch which comprises a movable contact element having a pair of movable contacts secured thereto, a pair of fixed contacts for individually contacting with the movable contacts, a pair of fixed contact elements to which the fixed contacts are individually secured, an electromagnetic driving device including a fixed iron core and a movable iron core as well as a coil electrically connected in series to one of the fixed contact elements, a first operating rod for transmitting movement of the movable iron core, a second operating rod disposed between the movable contact element and the first operating rod for transmitting movement of the first operating rod to the movable contact element, the second operating rod having a first portion, and a fixed guide for guiding the first portion of the second operating rod for movement along an axial line thereof, the movable contact element being located adjacent an axial end of the first portion of the second operating rod, the second operating rod further having a second portion formed at the other axial end of the first portion thereof for contacting with the first operating rod, the first operating rod being disposed such that an axial line thereof is aligned with the axial line of the first portion of the second operating rod.

With the switch, since the first operating rod is disposed such that the axial line thereof is alined with the axial line of the first portion of the second operating rod, the frictional force acting upon the second operating rod when the first operating rod is operated by the movable iron core of the electromagnetic driving device is reduced. Accordingly, the opening speed of the movable contacts is high and the current limiting performance of the switch is high.

According to another aspect of the present invention, there is provided a switch which comprises a movable contact element having a pair of movable contacts secured thereto, a pair of fixed contacts for individually contacting with the movable contacts, a pair of fixed contact elements to which the fixed contacts are individually secured, an electromagnetic driving device including a fixed iron core and a movable iron core as well as a coil electically connected in series to one of the fixed contact elements, a first operating rod for transmitting movement of the movable iron core to the movable contact element, an electromagnet including a fixed iron core and a movable iron core as well as a coil electrically isolated from the fixed contact elements, a transmitting member for transmitting movement of the movable iron core of the electromagnet, and a second operating rod for transmitting movement of the transmitting member to the movable contact element, the second operating rod having an axial through-hole formed therein, the first operating rod being partially fitted in the through-hole of the second operating rod.

With the switch, since the first operating rod is fitted for movement in the axial through-hole formed in the second operating rod, the movable contacts are opened at a high speed by the electromagnetic device. Accordingly, the switch has a high current limiting performance due to such high speed opening of the movable contacts.

According to a further aspect of the present invention, there is provided a switch which comprises a movable contact element having a pair of movable contacts secured thereto, a pair of fixed contacts for individually contacting with the movable contacts, a pair of fixed contact elements to which the fixed contacts are individually secured, an electromagnetic driving device including a fixed iron core and a movable iron core as well as a coil, an operating rod for transmitting movement of the movable iron core to open the movable contacts from the fixed contacts when excessively high current flows through the coil, a transmitting member disposed for moving the movable contact element, an electromagnet disposed on one side of the electromagnetic driving device for remotely controlling contacting movement of the movable contacts with the fixed contacts by way of the transmitting member, a pair of terminals, a first conductor for electrically connecting an end of the coil to one of the fixed contact elements, a second conductor for electrically connecting the other end of the coil to one of the terminals, the electromagnetic driving device being disposed below the operating rod, and a current transformer disposed on the other side of the electromagnetic driving device for detecting electric current between the fixed contacts, one of the first and second conductors extending through the current transformer.

The above and other objects, features and advantages of the present invention will become apparent from the following description and the appended claims, taken in conjunction with the accompanying drawings in which like parts or elements are denoted by like reference characters.

DESCRIPTION OF THE PREFERRED EMBODIMENTS

Figure 1:
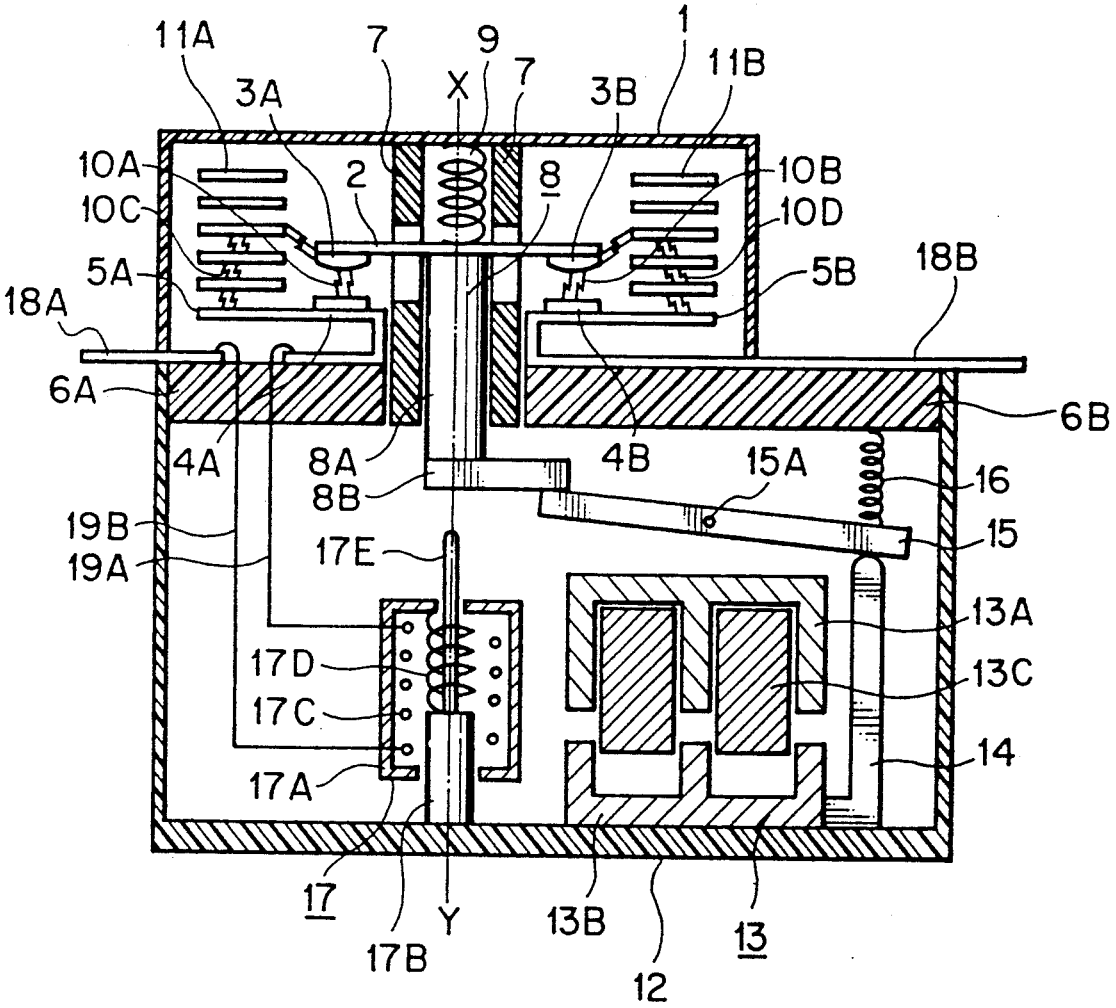
FIG. 1 is a side elevational sectional view of a switch showing a first preferred embodiment of the present invention.

Referring first to FIG. 1, there is shown a switch according to a first preferred embodiment of the present invention. The switch shown includes an arc box 1 in which a movable contact element 2 is accommodated. A pair of movable contacts 3A and 3B are secured to the opposite end portions of the movable contact element 2 for contacting with a pair of fixed contacts 4A and 4B, respectively. The fixed contacts 4A and 4B are secured to a pair of fixed contact elements 5A and 5B, respectively, which are, in turn, second to a pair of bases 6A and 6B, respectively, by means of screws not shown.

The arc box 1 has a guide 7 fixedly mounted in the inside thereof and further includes a second operating rod 8 having a first portion 8A fitted for vertical movement in the guide 7 and a second portion 8B integrally formed at and extending laterally from a lower end of the first portion 8A. The movable contact element 2 is located at the other or upper end of the first portion 8A of the second operating rod 8 across the guide 7, and the movable contact element 2 and second operating rod 8 are normally urged downwardly by a first spring 9 fitted in the guide 7. A pair of sets of arc-extinguishing plates 11A and the 11B made of a magnetic metal material are disposed on the opposite sides of the movable contact element 2 for extinguishing arcs 10A and 10B which may be produced between the movable contacts 3A and 3B and fixed contact elements 4A and 4B, respectively.

An operating mechanism box 12 is secured to the bottom of the arc box 1 and has an electromagnet 13 accommodated therein. The electromagnet 12 includes a fixed iron core 13A, a movable iron core 13B and a coil 13C. A first transmitting member 14 is secured to the movable iron core 13B of the electromagnet 13. A second transmitting member 15 is supported for pivotal motion around a fixed shaft 15A and normally urged at an end portion thereof by a second spring 16 so that the end portion thereof is held in contact with a top end of the first transmitting member 14 while the other end portion thereof is held in contact with a lower face of the second portion 8B of the second operating rod 8.

An electromagnetic driving device 17 is located in the operating mechanism box 12 and includes a fixed iron core 17A, a movable iron core 17B, a coil 17C, a biasing spring 17D and a first operating rod 17E. The second portion 8B of the second operating member 8 is disposed for engagement with an upper end of the first operating rod 17E of the electromagnetic driving device 17. The opposite ends of the coil 17C are electrically connected to the first fixed contact 5A and a first terminal 18A by way of a pair of first and second lead wires or conductors 19A and 19B, respectively. A second terminal 18B is electrically connected to the second contact 5B.

The switch of the first embodiment described above is characterized in that, as seen in FIG. 1, the first operating rod 17E is disposed in alignment with the first portion 8A which serves as a sliding guide portion for the second operating rod 8, that is, the axial line X-Y of the first operating rod 17E, or more precisely an upper extension of such axial line X-Y, coincides or is aligned with an axis of the first portion 8A of the second operating rod 8.

Figure 2:
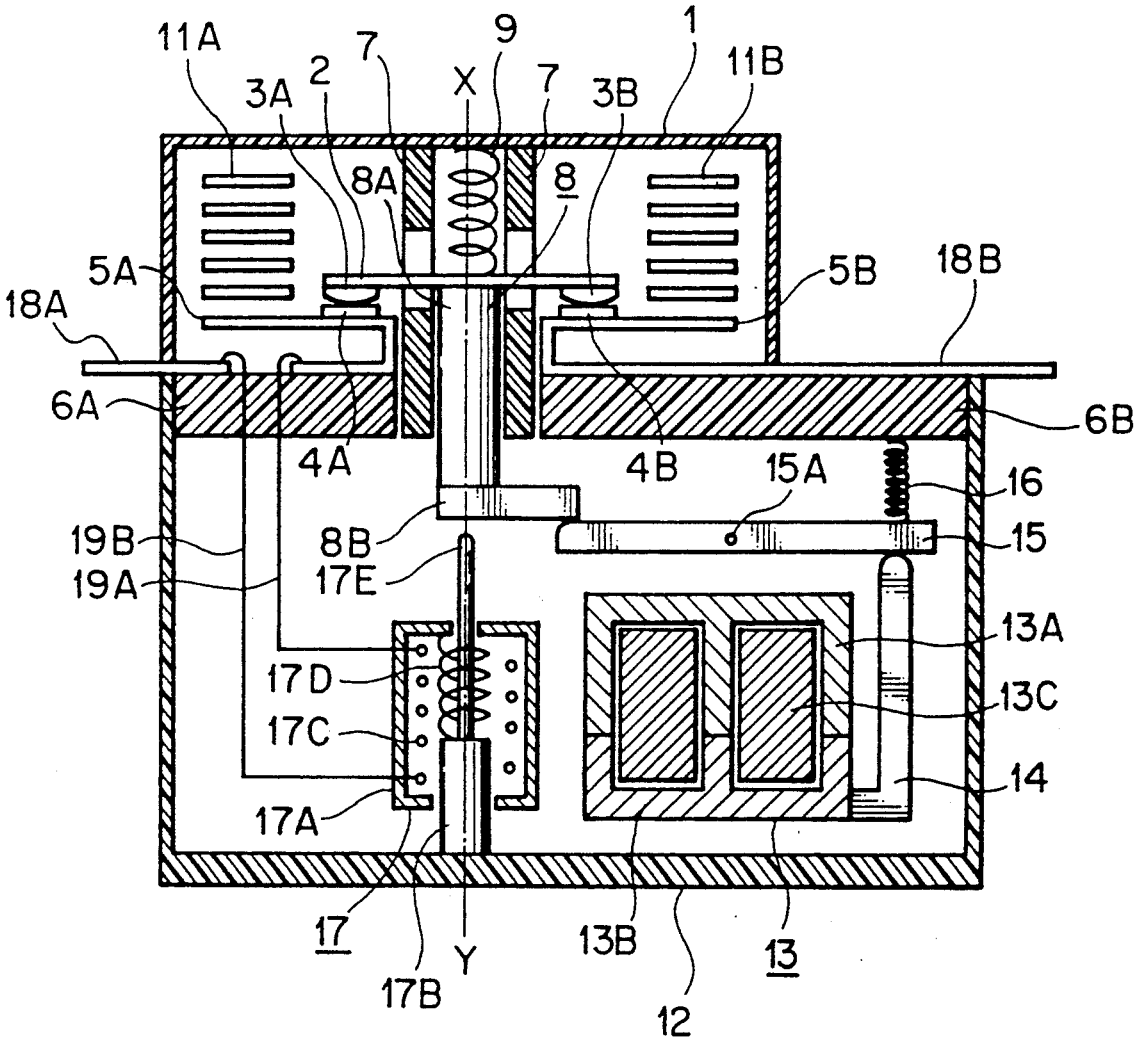
FIGS. 2 and 3 are similar views but showing the switch of FIG. 1 in different operating conditions.

In operation, when the coil 13C of the electromagnet 13 is energized, the movable iron core 13B of the electromagnet 13 is attracted to the fixed iron core 13A to move the first transmitting member 14 secured thereto upwardly. Thereupon, the second transmitting member 15 is pivoted in the counterclockwise direction in FIG. 1 around the fixed shaft 15A by the first transmitting member 14 to such a position as shown in FIG. 2. Consequently, the movable contact element 2 and second operating rod 8 are moved down by the urging force of the first spring 9 under the guidance of the guide 7. As a result, the movable contacts 3A and 3B on the movable contact element 2 are contacted with the fixed contacts 4A and 4B, respectively, as seen in FIG. 2 to allow load current to flow between the first and second terminals 18A and 18B by way of the movable contact element 2 and also by way of the coil 17C of the electromagnetic driving device 17.

Then, when the coil 13C of the electromagnet 13 is deenergized, the first and second transmitting members 14 and 15, movable iron core 13B of the electromagnet 13, second operating rod 8 and movable contact element 2 are returned to their respective home positions shown in FIG. 1 by the urging force of the second spring 16. Upon upward movement of the movable contact element 2 then, arcs 10A and 10B may be produced between the movable contacts 3A and 3B and fixed contacts 4A and 4B, respectively. The arcs 10A and 10B are attracted to and distorted by the magnetic metal arc-extinguishing plates 11A and 11B as indicated at 10C and 10C in FIG. 1, respectively. Such arcs 10C and 10D are cooled by the metal arc-extinguishing plates 11A and 11B, and consequently, they are extinguished at a zero point of ac current.

Figure 3:
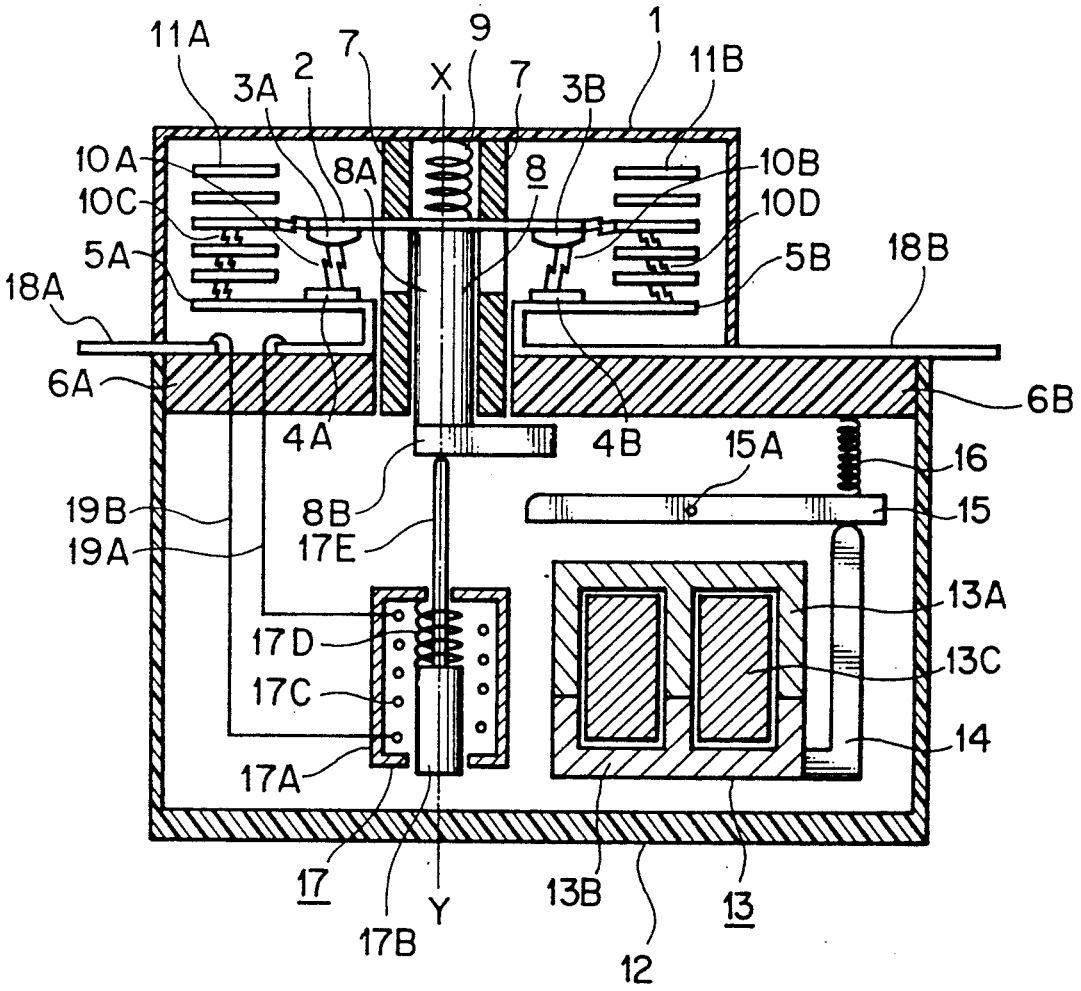

If a short-circuit accident happens in such condition of the switch as shown in FIG. 2, then high current will flow through the coil 17C of the electromagnetic driving device 17. Consequently, the movable iron core 17B of the electromagnetic driving device 17 is attracted to the fixed iron core 17A to move the first operating rod 17E upwardly to such a position as shown in FIG. 2. Accordingly, the second operating rod 8 and movable contact 2 are moved upwardly by the first operating rod 17E. As a result, arcs 10A and 10B may be produced between the movable contacts 3A and 3B and fixed contacts 4A and 4B, respectively. Also in this instance, the arcs 10A and 10B are attracted to and deformed or elongated by the magnetic metal arc-extinguishing plates 11A and 11B into such arcs as indicated at 10C and 10D in FIG. 3. Consequently, the resistance of the arcs increase, and as a result, short-circuit current is limited. Such short-circuit current is interrupted by a breaker not shown.

With the switch of the first embodiment described above, since the first and second operating rods 17E and 8 are disposed such that the first portion 8A serving as a sliding guide portion of the second operating rod 8 is disposed on the axial line X-Y of the first operating rod 17E, the second operating rod 8 is moved smoothly in the guide 7 and the frictional force between them is small. Accordingly, upon interruption due to high current, the second operating rod 8 can be moved at a high speed, and consequently, the movable contacts 3A and 3B are opened at a high speed thereby to increase the lengths of the arcs 10A and 10B suddenly. As a result, the electric resistances of the arcs 10A and 10B are increased suddenly thereby to limit the short-circuit current. Accordingly, the switch has a high current limiting performance. Further, since the switch of the present embodiment includes the electromagnet 13, remote switching of the load current can be performed, and besides, since the electromagnet 13 is located alongside the electromagnetic driving device 17, the overall height of the switch is reduced accordingly.

Figure 4:
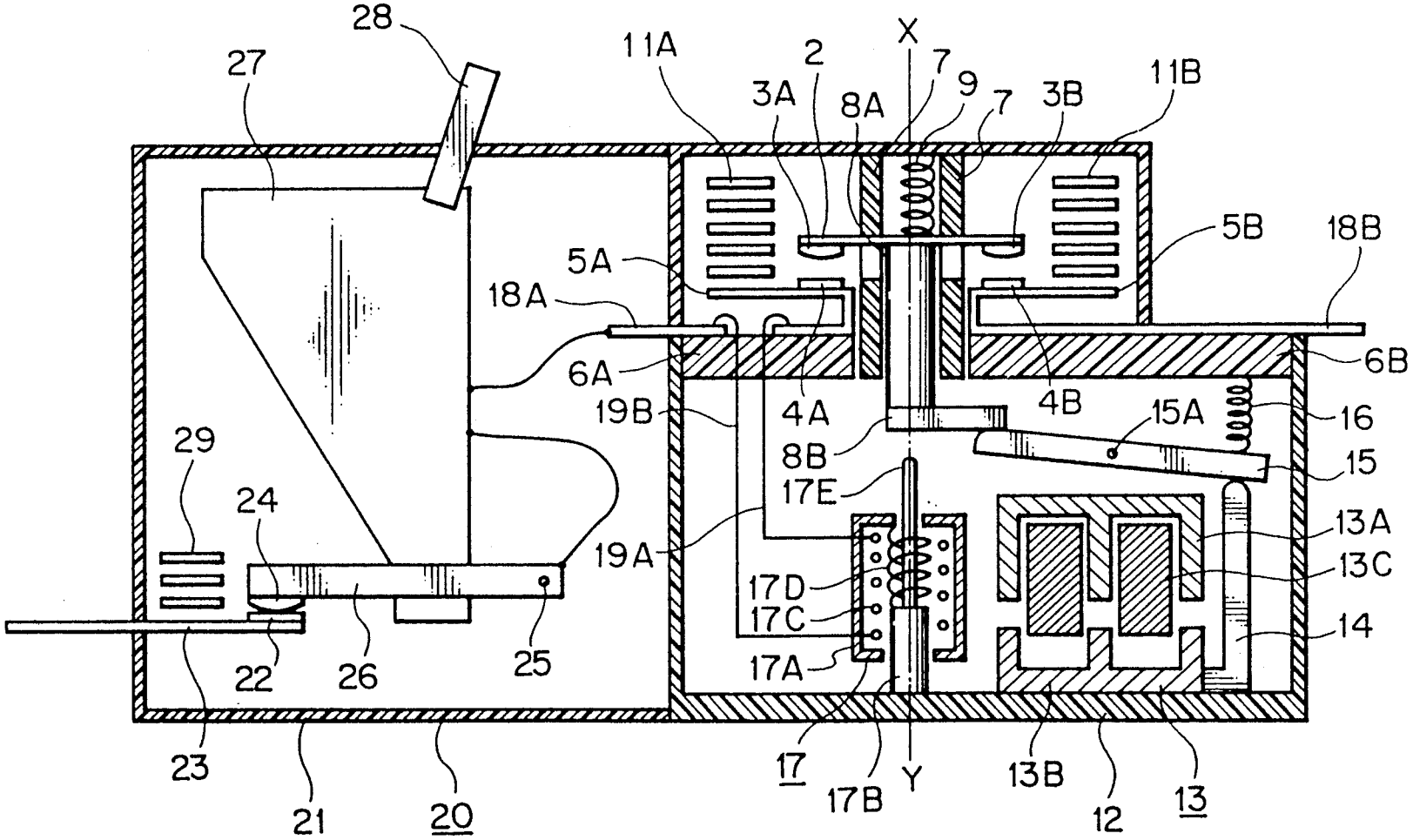
FIG. 4 is a side elevational sectional view of a modification to the switch of FIG. 1.

Referring now to FIG. 4, there is shown a modification to the switch of FIG. 1 described above. The modified switch includes an additional mechanism to the switch of FIG. 1. The additional mechanism is a breaker section 20 including a casing 21, a fixed contact element 23 disposed in the casing 21 and having a fixed contact 22 secured thereto, a movable contact element 26 supported for pivotal motion around a fixed shaft 25 and having a movable contact 24 secured thereto for contacting with the fixed contact 22 of the fixed contact element 23, an operating mechanism 27 for pivoting the movable contact element 26 around the fixed shaft 25 to automatically open the movable contact 24 of the movable contact element 26 when excessively high current flows and also for opening the movable contact 24 by manual operation of a handle 28, and a plurality of arc-extinguishing plates 29 for extinguishing an arc which may be produced between the movable contact 24 and fixed contact 22.

With the modified switch, if excessively high current such as, for example, short-circuit current, flows, then the operating mechanism 27 of the breaker section 20 operates automatically to open the movable contact 24, whereupon an arc may be produced between the movable contact 24 and fixed contact 22. Such arc is extinguished by the metal arc-extinguishing plates 29. After then, the open condition of the movable contact 24 is maintained by operation of the operating mechanism 27. Accordingly, the modified switch can effect interruption of excessively high current. It is to be noted that opening or closing of load current can be performed by manual operation of the handle 28.

Figure 5:
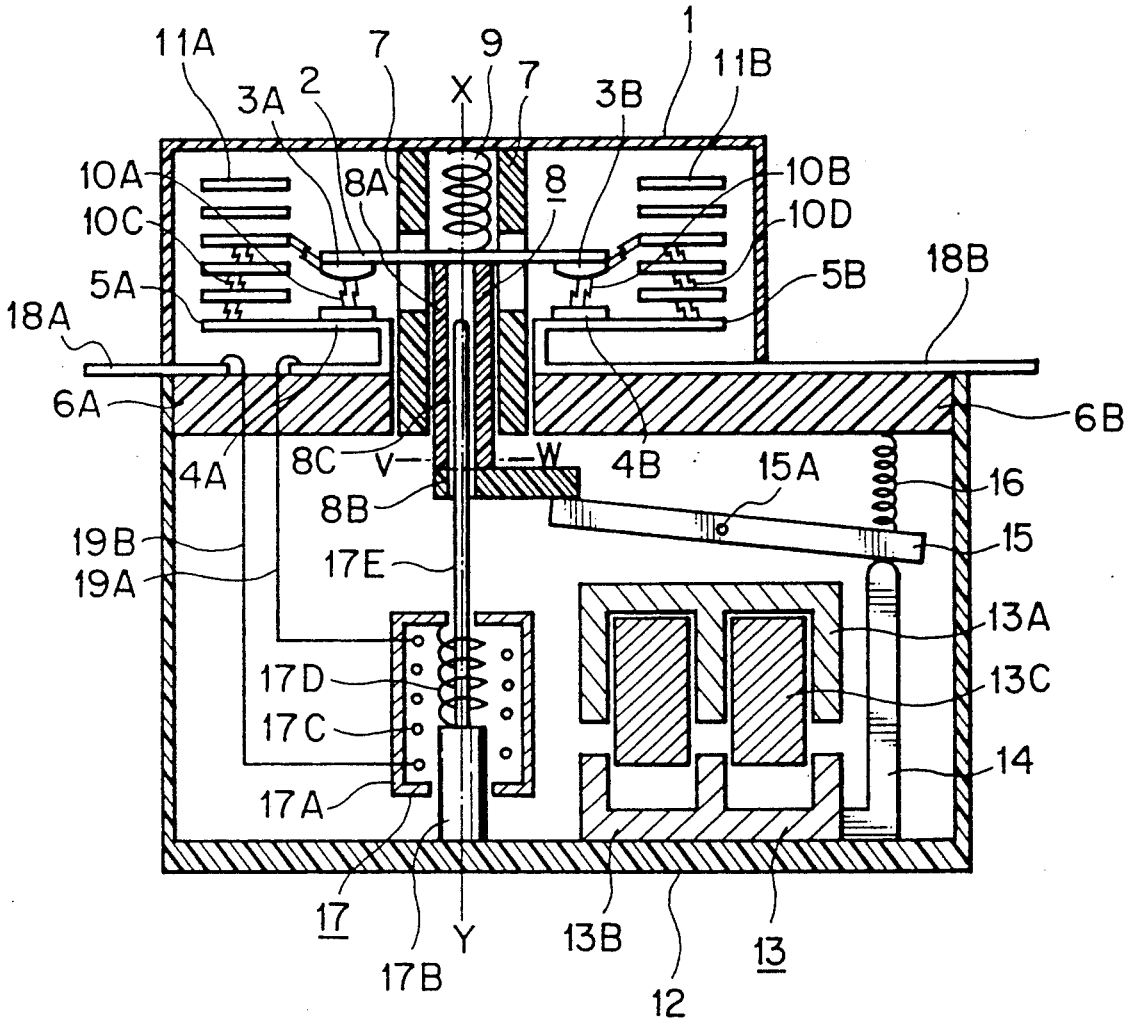
FIG. 5 is a side elevational view of a switch showing a second preferred embodiment of the present invention.

Referring now to FIG. 5, there is shown a switch according to a second preferred embodiment of the present invention. The switch shown includes an arc box 1 in which a movable contact element 2 is accommodated. A pair of movable contacts 3A and 3B are secured to the opposite end portions of the movable contact element 2 for contacting with a pair of fixed contacts 4A and 4B, respectively. The fixed contacts 4A and 4B are secured to a pair of fixed contact elements 5A and 5B, respectively, which are, in turn, secured to a pair of bases 6A and 6B, respectively, by means of screws not shown.

The arc box 1 has a guide 7 fixedly mounted in the inside thereof and further includes a second operating rod 8 having a first portion 8A fitted for vertical movement in the guide 7 and a second portion 8B integrally formed at and extending laterally from a lower end of the first portion 8A. The second operating rod 8 has an axial through-hole 8C formed therein along an axis of the first portion 8A. The movable contact element 2 is located at the other or upper end of the first portion 8A of the second operating rod 8 across the guide 7, and the movable contact element 2 and second operating rod 8 are normally urged downwardly by a first spring 9 fitted in the guide 7. A pair of sets of arc-extinguishing plates 11A and 11B made of a magnetic metal material are disposed on the opposite sides of the movable contact element 2 for extinguishing arcs 10A and 10B which may be produced between the movable contacts 3A and 3B and fixed contact elements 4A and 4B, respectively.

An operating mechanism box 12 is secured to the bottom of the arc box 1 and has an electromagnet 13 disposed therein in an electrically isolated condition from the fixed contact elements 5A and 5B. The electromagnet 13 includes a fixed iron core 13A, a movable iron core 13B and a coil 13C. A first transmitting member 14 is connected to transmit movement of the movable iron core 13B of the electromagnet 13 to a second transmitting member 15, and the second transmitting member 15 is supported for pivotal motion around a fixed shaft 15A for transmitting movement of the first transmitting member 14 to the second operating rod 8. The second transmitting member 15 is normally urged at an end portion thereof by a second spring 16 so that the end portion thereof is held in contact with a top end of the first transmitting member 14 while the other end portion thereof is held in contact with a lower face of the second portion 8B of the second operating rod 8.

An electromagnetic driving device 17 is located in the operating mechanism box 12 and includes a fixed iron core 17A, a movable iron core 17B, a coil 17C, a biasing spring 17D and a first operating rod 17E. The coil 17C is electrically connected in series to one of the fixed contact elements 5A and 5B, and the first operating rod 17E is partially fitted in the axial through-hole 8C of the second operating rod 8 as shown in a sectional view of FIG. 6 taken along line V-W of FIG. 5. The opposite ends of the coil 17C are electrically connected to the first fixed contact 5A and a first terminal 18A by way of a pair of first and second lead wires or conductors 19A and 19B, respectively. A second terminal 18B is electrically connected to the second contact element 5B.

Figure 7:
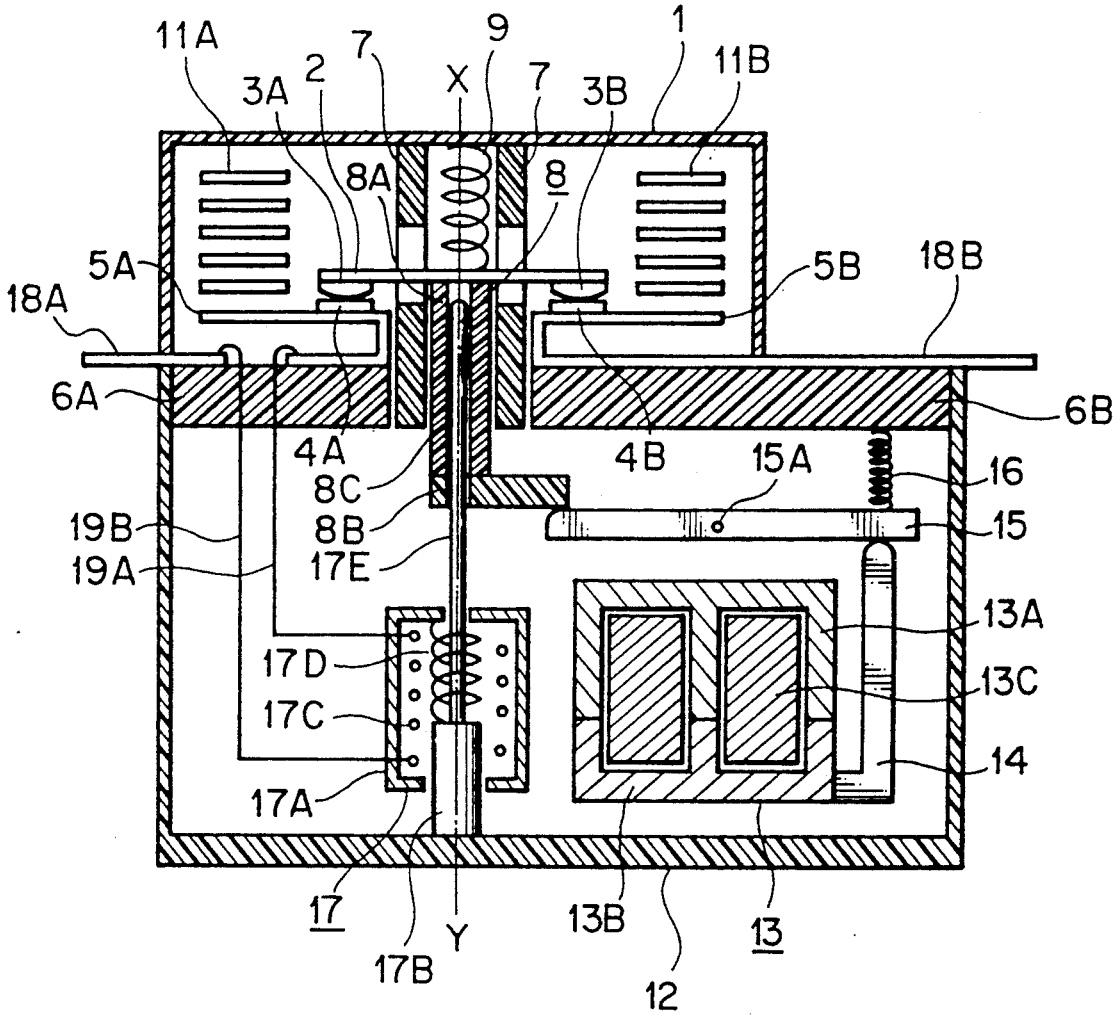
FIGS. 7 and 8 are views similar to FIG. 5 but showing the switch at different operating conditions.

In operation, when the coil 13C of the electromagnet 13 is energized, the movable iron core 13B of the electromagnet 13 is attracted to the fixed iron core 13A to move the first transmitting member 14 connected thereto upwardly. Thereupon, the second transmitting member 15 is pivoted in the counterclockwise direction in FIG. 5 around the fixed shaft 15A by the first transmitting member 14. Consequently, the movable contact element 2 and second operating rod 8 are moved down by the urging force of the first spring 9 under the guidance of the guide 7 to such a position as shown in FIG. 7. As a result, the movable contacts 3A and 3B on the movable contact element 2 are contacted with the fixed contacts 4A and 4B, respectively, as seen in FIG. 7 to allow load current to flow between the first and second terminals 18A and 18B by way of the movable contact element 2 and also by way of the coil 17C of the electromagnetic driving device 17.

Then, when the coil 13C of the electromagnet 13 is deenergized, the first and second transmitting members 14 and 15, movable iron core 13B of the electromagnet 13, second operating rod 8 and movable contact element 2 are returned to their respective home positions shown in FIG. 5 by the urging force of the second spring 16. Upon upward movement of the movable contact element 2 then, arcs 10A and 10B may be produced between the movable contacts 3A and 3B and fixed contacts 4A and 4B, respectively. The arcs 10A and 10B are attracted to and deformed by the magnetic metal arc-extinguishing plates 11A and 11B as indicated at 10C and 10D, respectively, in FIG. 5. Such arcs 10C and 10D are cooled by the metal arc-extinguishing plates 11A and 11B, and consequently, they are extinguished at a zero point of ac current.

Figure 8:
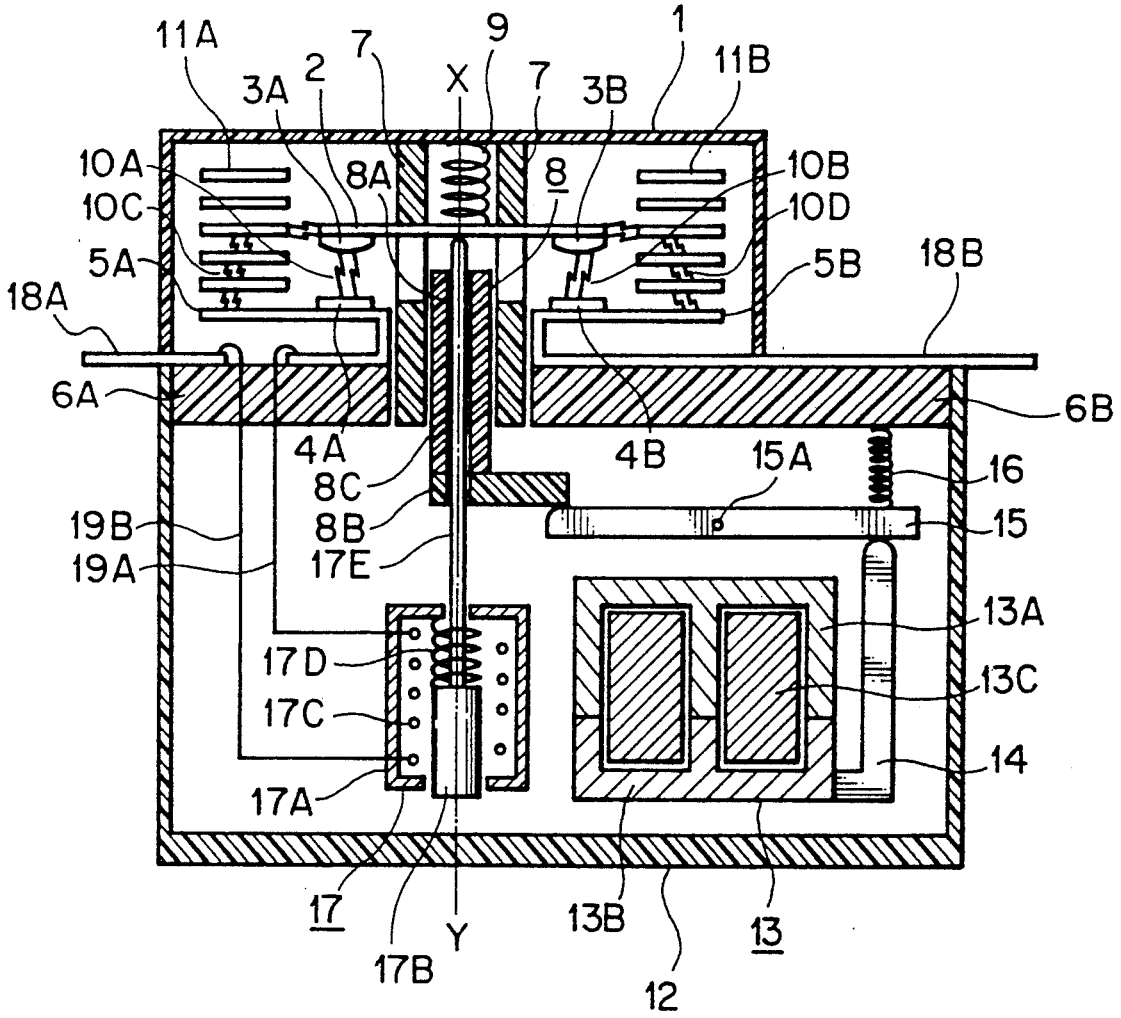

If a short-circuit accident happens in such condition of the switch as shown in FIG. 7, then high current will flow through the coil 17C of the electromagnetic driving device 17. Consequently, the movable iron core 17B of the electromagnetic driving device 17 is attracted to the fixed iron core 17A to move the first operating rod 17E upwardly to such a position as shown in FIG. 8. Accordingly, the movable contact 2 is moved upwardly by the first operating rod 17E. As a result, arcs 10A and 10B may be produced between the movable contacts 3A and 3B and fixed contacts 4A and 4B, respectively. Also in this instance, the arcs 10A and 10B are attracted to and deformed or elongated by the magnetic metal arc-extinguishing plates 11A and 11B into such arcs as indicated at 10C and 10D in FIG. 8. Consequently, the resistance of the arcs increase, and as a result, the short-circuit current is limited. Such short-circuit current is interrupted by a breaker not shown.

With the switch of the second embodiment described above, since the second operating rod has the axial through-hole formed therein and the first operating rod is disposed such that it may move in the axial through-hole, the first operating rod will not be acted upon by strong frictional force at all. Further, the movable contact element is driven directly by the first operating rod of the small size and hence of the small weight. Accordingly, when excessively high current flows, the movable contact is opened at a high speed by the electromagnetic driving device. As a result, arcs which are possibly produced between the fixed contacts and movable contacts are elongated suddenly and the arc resistance is increased quickly, and accordingly, the switch has a superior current limiting performance.

Figure 6:
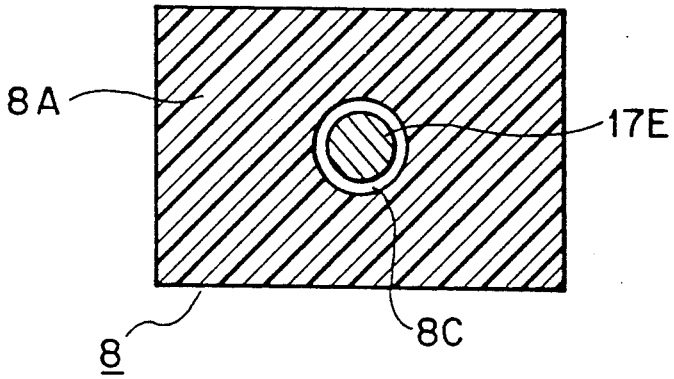
FIG. 6 is an enlarge sectional view taken along line V-W of FIG. 5.
Figure 9:
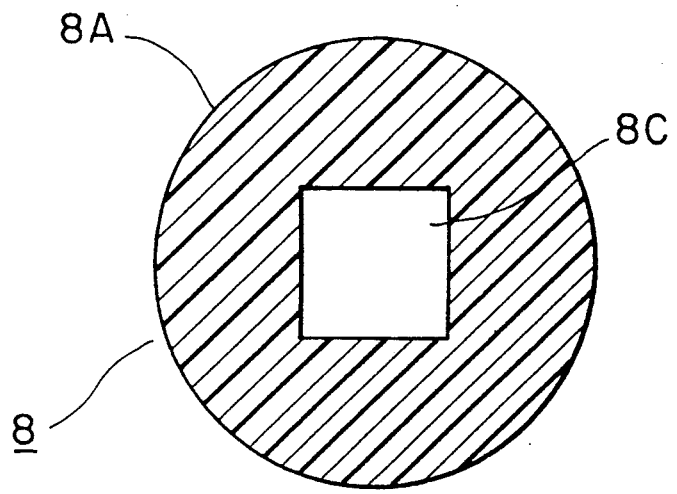
FIGS. 9 and 10 are sectional views taken along line V-W of FIG. 5 but showing alternative sections of a second operating rod of the switch.
Figure 10:
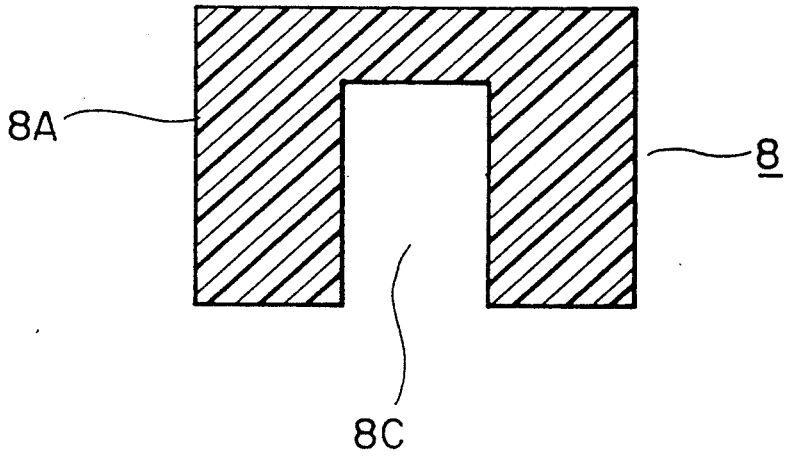

It is to be noted that, while the sectional area of the second operating rod 8 in the switch of the second embodiment described above has such a rectangular shape as seen in FIG. 6, it may alternatively have such a circular shape as shown in FIG. 9. Further, while the sectional area of the axial through-hole of the second operating rod 8 may have such a circular shape as shown in FIG. 6, it may alternatively have such a square shape as shown in FIG. 9 or such a different shape as shown in FIG. 10.

Figure 11:
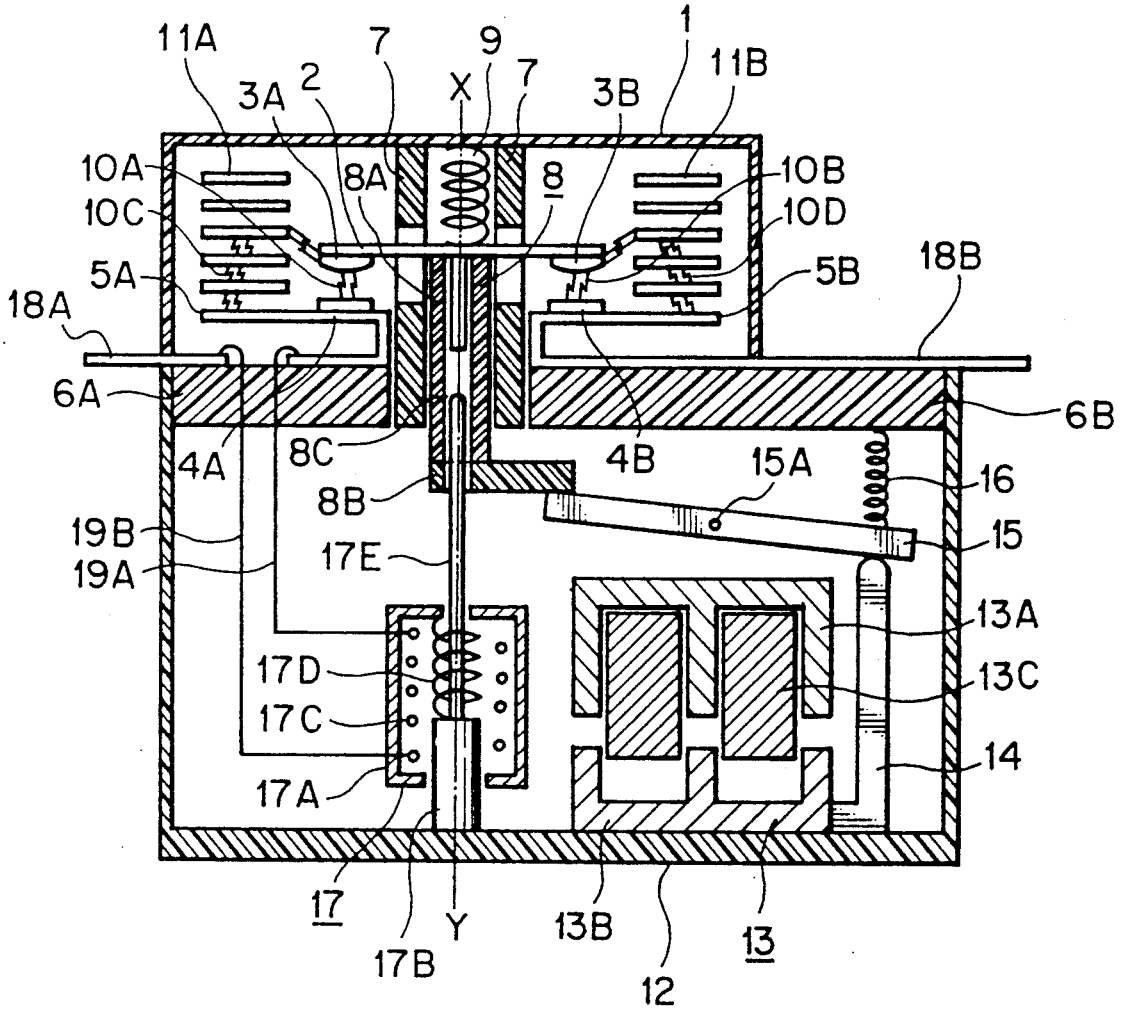
FIGS. 11 to 13 are side elevational sectional vies of different modifications to the switch of FIG. 5.
Figure 12:
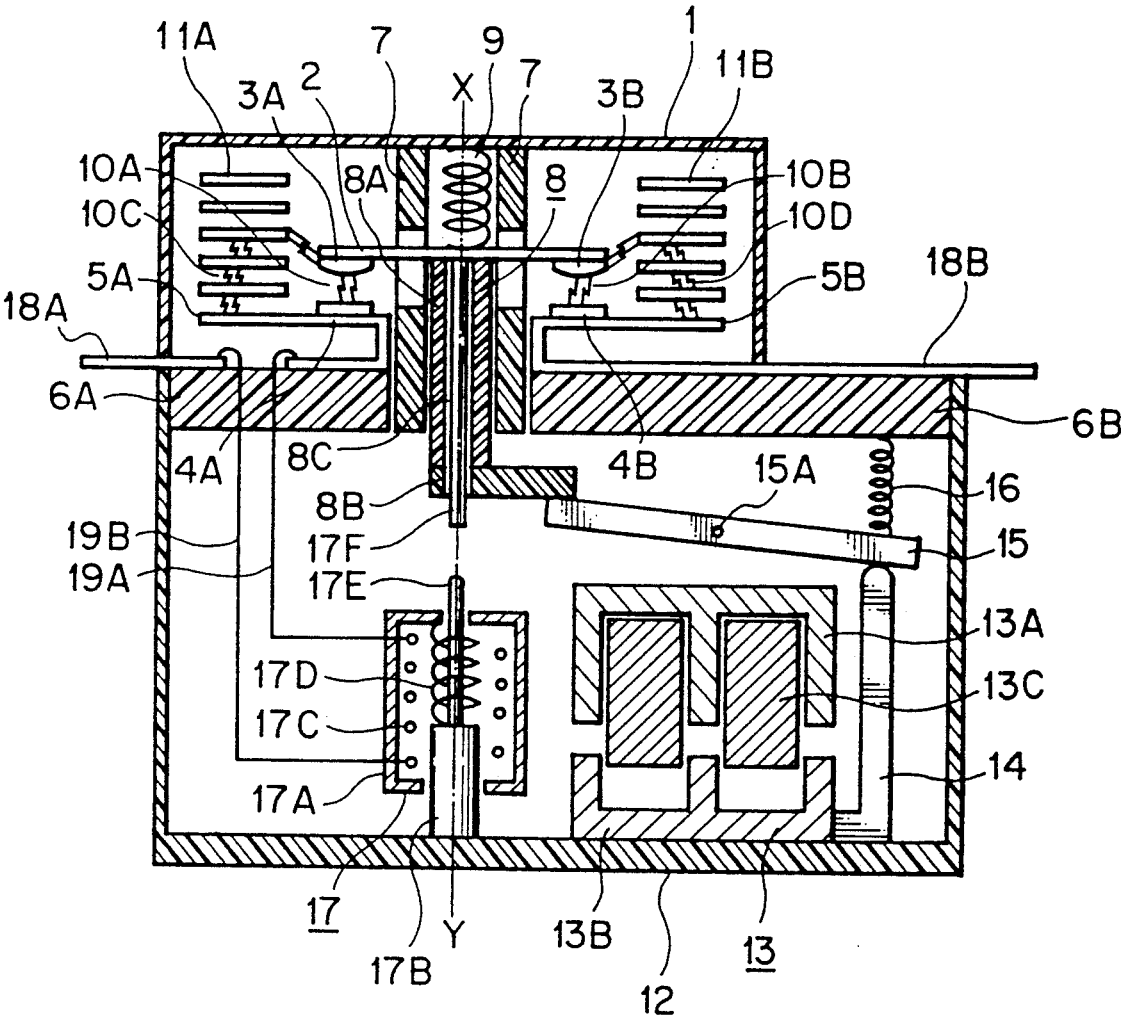

Further, the first operating rod 17E may be divided into two parts in such a manner as shown in FIGS. 11 or 12. In either of such instances, one of the two divisional parts is secured to the movable iron core of the electromagnetic driving device 17 while the other divisional part is connected to the movable contact element 2 in an axially aligned condition with the one divisional part.

Figure 13:
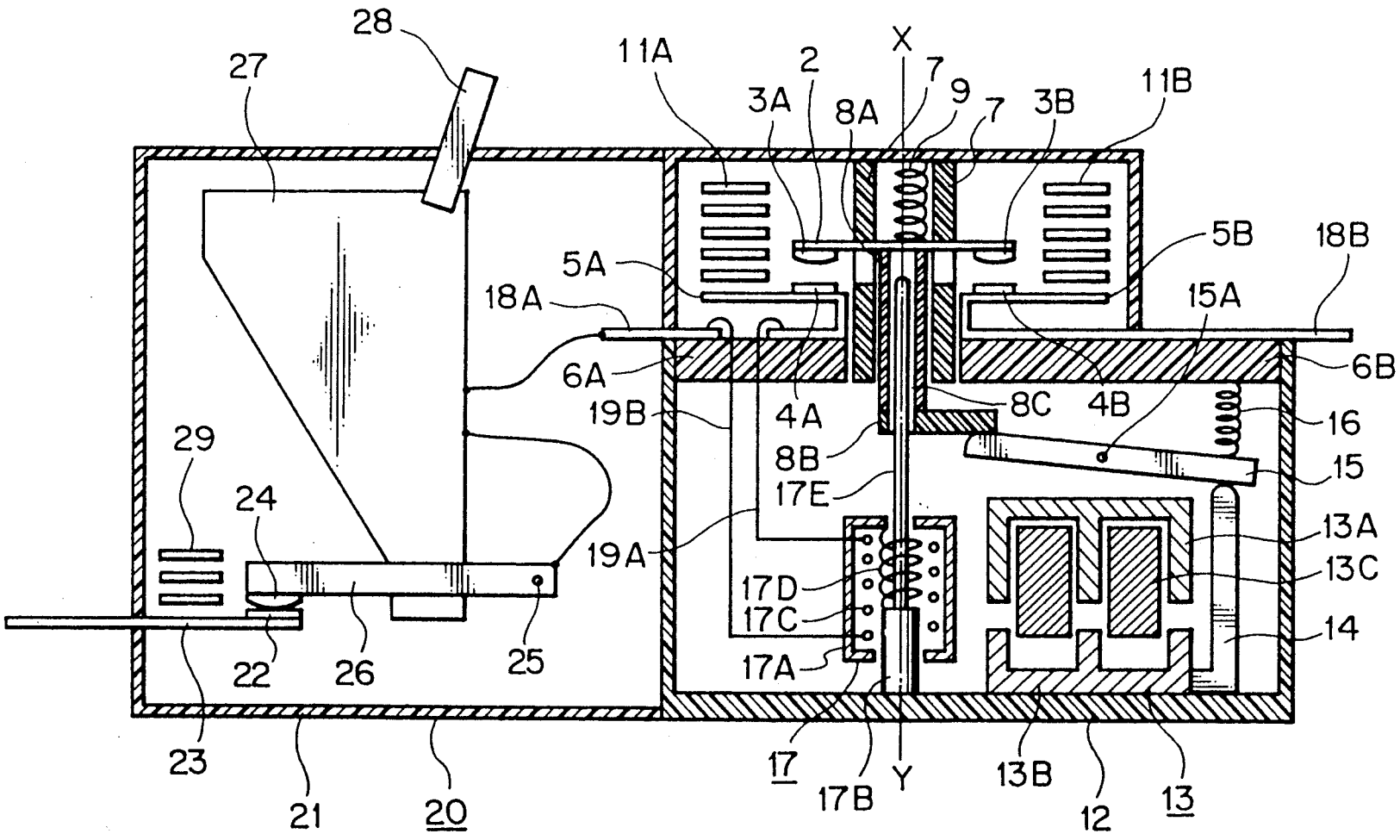

Referring now to FIG. 13, there is shown a modification to the switch of FIG. 5 described above. Similarly to the modified switch shown in FIG. 5, also the present modified switch includes a breaker section 20 including a casing 21, a fixed contact element 23 disposed in the casing 21 and having a fixed contact 22 secured thereto, a movable contact element 26 supported for pivotal motion around a fixed shaft 25 and having a movable contact 24 secured thereto for contacting with the fixed contact 22 of the fixed contact element 23, an operating mechanism 27 for pivoting the movable contact element 26 around the fixed shaft 25 to open the movable contact 24 of the movable contact element 26 when excessively high current flows and also for opening the movable contact 24 by manual operation of a handle 28, and a plurality of arc-extinguishing plates 29 for extinguishing an arc which may be produced between the movable contact 24 and fixed contact 22.

With the modified switch, if excessively high current such as, for example, short-circuit current, flows, then such excessively high current is limited by the arcs 10A, 10B or 10C, 10D in the arc box 1 as described hereinabove. Meanwhile, the operating mechanism 27 of the breaker section 20 operates to open the movable contact 26, whereupon an arc may be produced between the movable contact 24 and fixed contact 22. Such arc is extinguished by the metal arc-extinguishing plates 29. After then, the open condition of the movable contact 24 is maintained by operation of the operating mechanism 27. Accordingly, the modified switch can effect not only limitation to but also interruption of excessively high current. It is to be noted that opening or closing of load current can be performed by manual operation of the handle 28.

Figure 14:
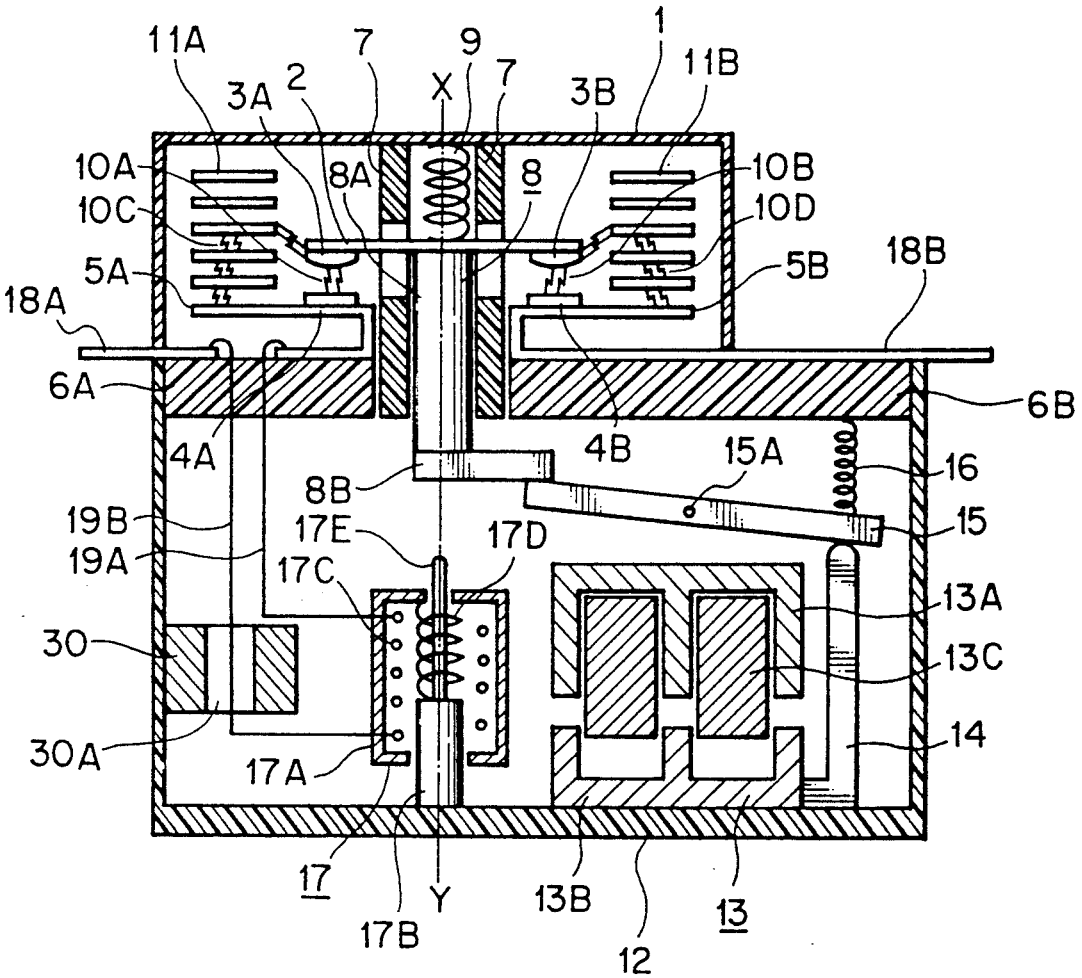
FIGS. 14 and 15 are side elevational sectional views of a switch showing a third preferred embodiment of the present invention.

Referring now to FIG. 14, there is shown a switch according to a third preferred embodiment of the present invention. The switch of the present embodiment is substantially similar in construction to but is different from the switch of the first embodiment of FIG. 1 described hereinabove in that it additionally includes a current transformer 30 for detecting electric current flowing through the coil 17C of the electromagnetic driving device 17 and hence between the fixed contact elements 5A and 5B. The current transformer 30 has a through-hole 30A perforated therein.

The switch of the present embodiment is constituted such that the electromagnetic driving device 17 is disposed such that it lies on an axial line of the second operating rod 8, more particularly on a lower extension of such axial line, and the electromagnet 13 is disposed on one side of the electromagnetic driving device 17 while the current transformer 30 is disposed on the opposite side of the electromagnetic driving device 17, and the second lead wire or conductor 19B of the coil 17C of the electromagnetic driving device 17 extends through the through-hole 30A of the current transformer 30.

The switch of the present embodiment operates in a substantially similar manner as the switch of the first embodiment of FIG. 1 described hereinabove, and accordingly, overlapping description thereof is omitted herein.

With the construction of the switch described above, the current transformer 30 and electromagnet 13 can be disposed on the opposite sides of the electromagnetic driving device 17 and accordingly can be accommodated in the same operating mechanism box 12. Consequently, the overall size of the switch can be minimized.

Figure 15:
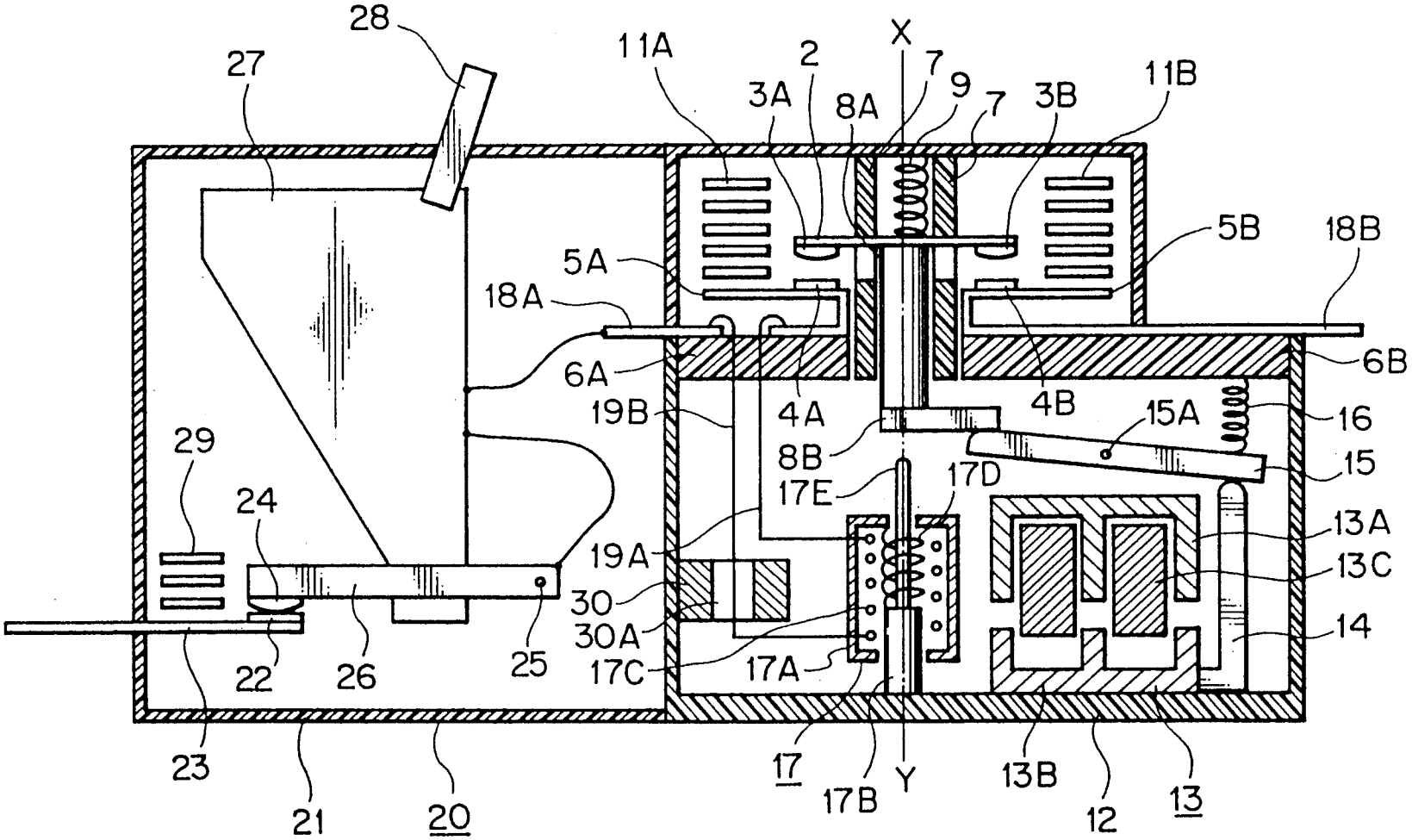
Figure 16:
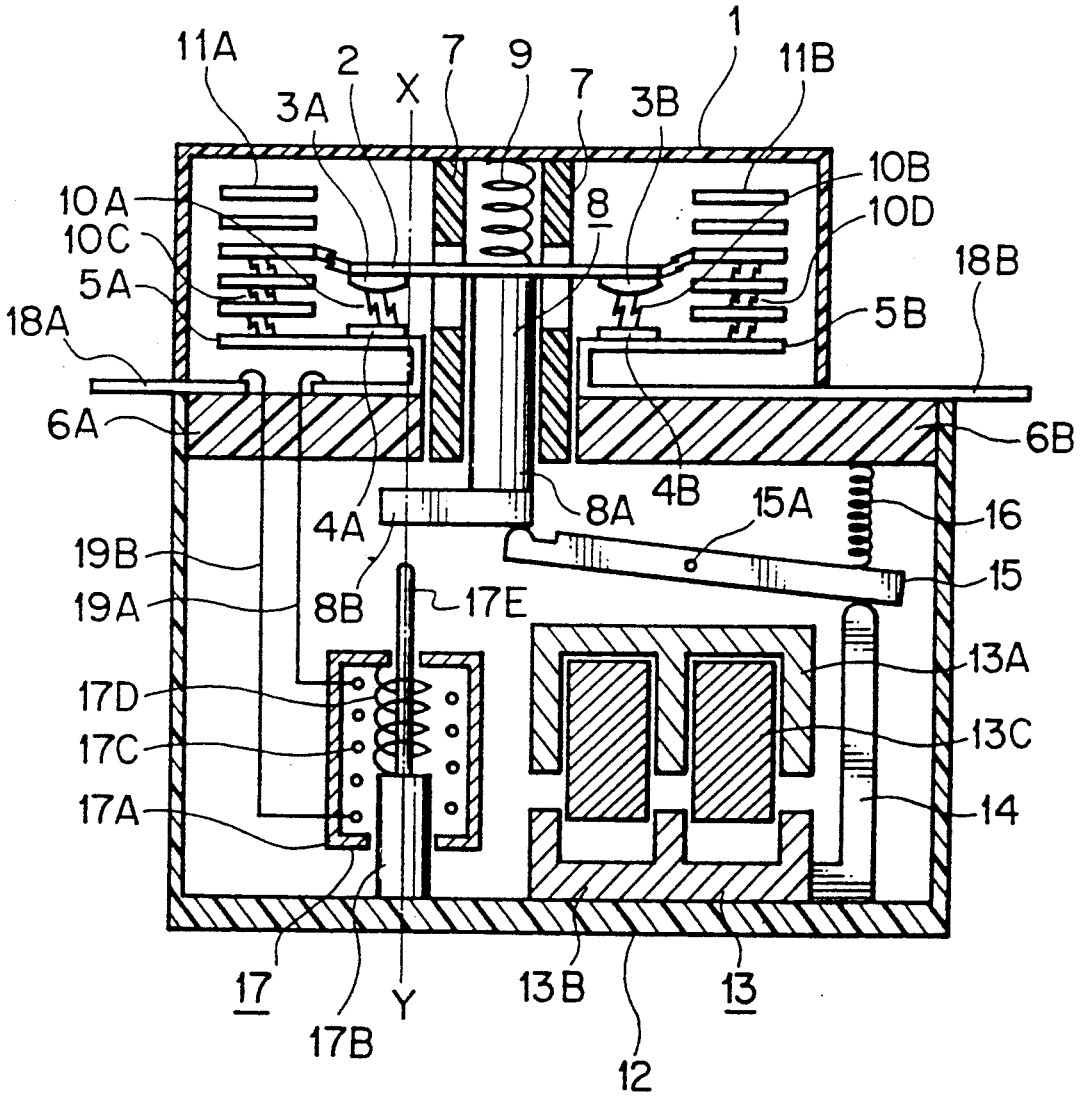
FIG. 16 PRIOR ART
FIG. 16 is a side elevational sectional view of a conventional switch.
Figure 17:
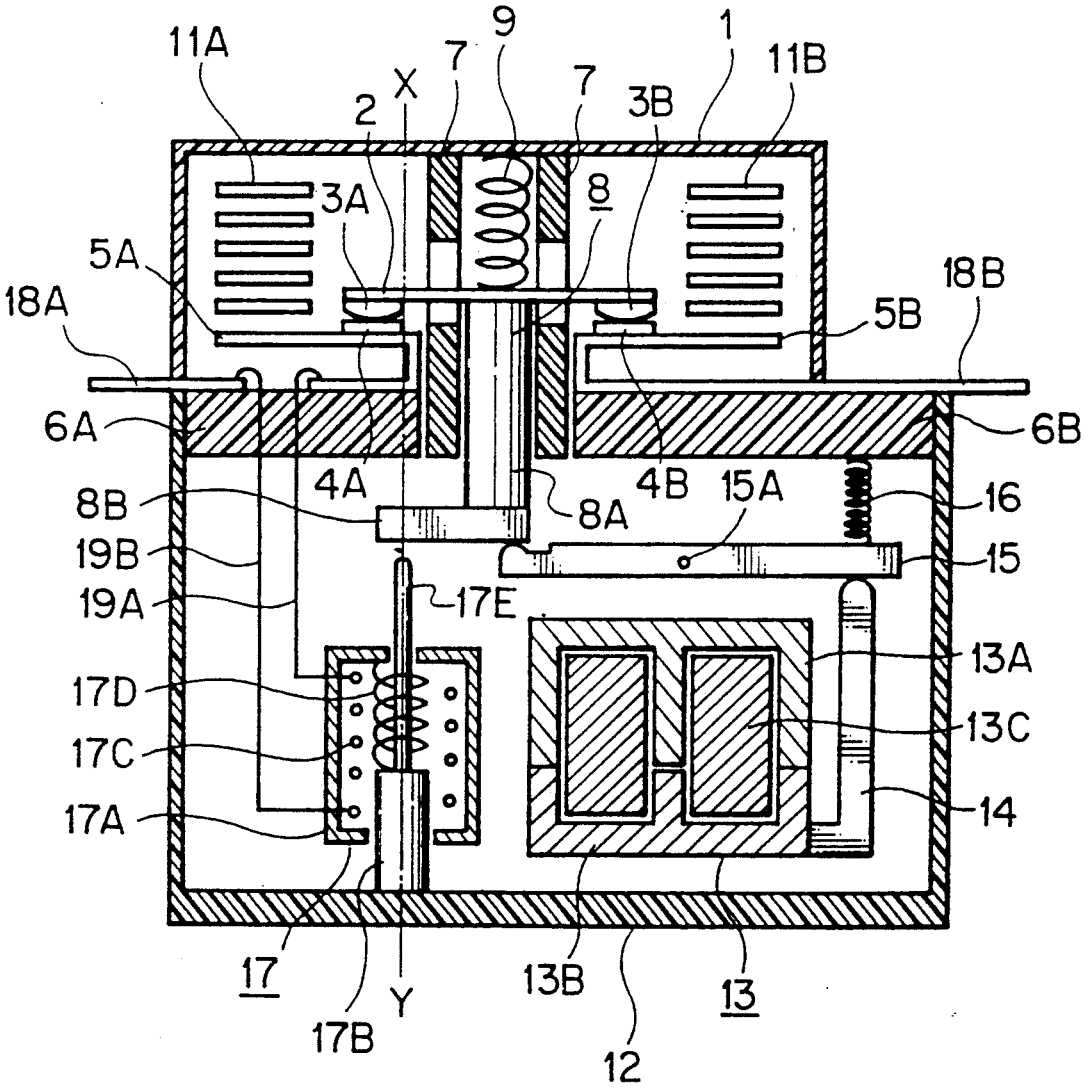
FIG. 17 PRIOR ART
FIGS. 17 and 18 are similar view but showing the switch of FIG. 16 in different operating conditions.
Figure 18:
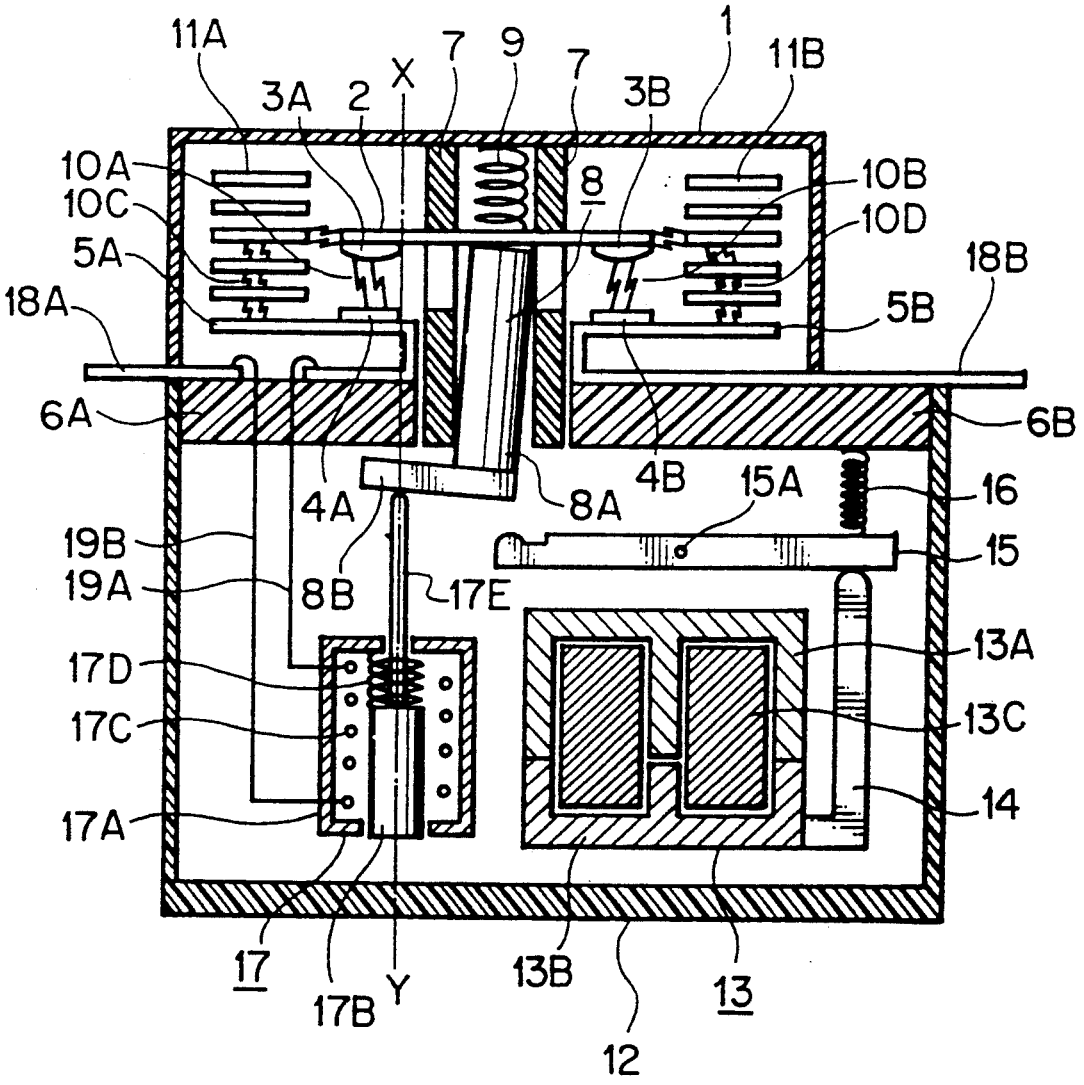
FIG. 18 PRIOR ART

Referring now to FIG. 15, there is shown a modification to the switch of FIG. 14 described above. Similarly to the modified switches shown in FIGS. 4 and 13, also the present modified switch includes a breaker section 20 including a casing 21, a fixed contact element 23 disposed in the casing 21 and having a fixed contact 22 secured thereto, a movable contact element 26 supported for pivotal motion around a fixed shaft 25 and having a movable contact 24 secured thereto for contacting with the fixed contact 22 of the fixed contact element 23, an operating mechanism 27 for pivoting the movable contact element 26 around the fixed shaft 25 to automatically open the movable contact 24 of the movable contact element 26 when excessively high current flows and also for opening the movable contact 24 by manual operation of a handle 28, and a plurality of arc-extinguishing plates 29 for extinguishing an arc which may be produced between the movable contact 24 and fixed contact 22.

With the modified switch, if excessively high current such as, for example, short-circuit current, flows, then the operating mechanism 27 of the breaker section 20 operates automatically to open the movable contact 24, whereupon an arc may be produced between the movable contact 24 and fixed contact 22. Such arc is extinguisher by the metal arc-extinguishing plates 29. After then, the open condition of the movable contact 24 is maintained by operation of the operating mechanism 27. Accordingly, the modified switch can also effect interruption of excessively high current. It is to be noted that opening or closing of load current can be performed by manual operation of the handle 28.

Also the modified switch is advantageous in that it can be made in a minimized overall size similarly to the switch shown in FIG. 14.

It is to be noted that such current transformer 30 as shown in FIG. 14 may be employed also in the switches shown in FIGS. 5 and 13.

Having now fully described the invention, it will be apparent to one of ordinary skill in the art that many changes and modifications can be made thereto without departing from the spirit and scope of the invention as set forth herein.

What is claimed is:

1. A switch comprising:

a movable contact element having a movable contact secured thereto;

a fixed contact for individually contacting with said movable contact;

a fixed contact element to which said fixed contact is individually secured;

an electromagnetic driving device including a fixed iron core as well as a coil electrically connected in series to said fixed contact element;

a first operating rod for transmitting movement of said movable iron core;

a second operating rod disposed between said movable contact element and said first operating rod for transmitting movement of said first operating rod to said movable contact element, said second operating rod having a first portion and a second portion formed at an axial end of said first portion for contacting with said first operating rod, said first portion being elongated along an axial line thereof; and a fixed guide for guiding said first portion of said second operating rod for movement along an axial line thereof; wherein said movable contact element is located adjacent the other axial end of said first portion of said second operating rod, and said first operating rod is disposed such that an axial line thereof is aligned with the axial line of said first portion of said second operating rod.

2. A switch as claimed in claim 1, further comprising a breaker section including an operating machanism for automatically interrupting electric current when excessively high current flows therethrough and also for interrupting electric current flow therethrough by manual operation of a handle, an electromagnet disposed along side said electromagnetic driving device and including a movable iron core, and a transmitting member for transmitting movement of said movable iron core of said electromagnet to said second operating rod to control contacting movement of said movable contact by operation of said electromagnet

3. A switch comprising:

a movable contact element having a movable contact secured thereto;

a fixed contact for individually contacting with said movable contact;

a fixed contact element to which said fixed contact is individually secured;

an electromagnetic driving device including a fixed iron core as well as a coil electrically connected in series to said fixed contact element;

a first operating rod for transmitting movement of said movable iron core to said movable contact element;

an electromagnet including a fixed iron core and a movable iron core as well as a coil electrically isolated from said fixed contact element;

a transmitting member for transmitting movement of said movable iron core of said electromagnet; and an axially elongated second operating rod, axially movable within a fixed guide, for transmitting movement of said transmitting member to said movable contact element, said second operating rod having an axial through-hole formed therein; wherein said first operating rod is axially aligned with and partially fitted in said through-hole of said second operating rod.

4. A switch as claimed in claim 3, further comprising a breaker section including an operating mechanism for automatically interrupting electric current when excessively high current flows therethrough and also for interrupting electric current flow therethrough by manual operation of a handle.

5. A switch as claimed in claim 3, wherein said first operating rod is composed of a first portion secured to said movable contact element and fitted in said second operating rod, and a second portion secured to said movable iron core of said electromagnetic driving device.

6. A switch as claimed in claims 3, 4, or 5, further comprising a current transformer disposed on one side of said electromagnetic driving device for detecting electric current flowing through said coil of said electromagnetic driving device, said coil of said electromagnetic driving device having a pair of lead wires connected to the opposite ends thereof, one of said lead wires extending through said current transformer.

7. A switch comprising:

a movable contact element having a movable contact secured thereto;

a fixed contact for individually contacting with said movable contact;

a fixed contact element to which said fixed contact is individually secured;

an electromagnetic driving device including a fixed iron core as well as a coil;

an operating rod for transmitting movement of said movable iron core to open said movable contact from said fixed contact when excessively high current flows through said coil;

a transmitting member disposed for moving said movable contact element;

an electromagnet disposed on one side of said eletromagnetic driving device for remotely controlling contacting movement of said movable contact with said fixed contact by said transmitting member moving an axially elongated second operating rod attached to said moveable contact element and guided in a fixed guide;

a pair of terminals;

a first conductor for electrically connecting an end of said coil to said fixed contact element;

a second conductor for electrically connecting the other end of said coil to one of said terminals; and a current transformer; wherein said electromagnetic driving device is disposed below said operating rode, and the current transformer is disposed on the other side of said electromagnetic driving device for detecting electric current across said fixed and moving contacts, one of said first and second conductors extending through said current transformer.

8. A switch as claimed in claim 1, wherein said movable contact comprises a first and a second movable contact, said fixed contact comprises a first and a second fixed contact for individually contacting with said first and second movable contacts, respectively, said fixed contact element comprises a first and a second fixed contact element to which said first and second fixed contacts are individually secured, and said coil is electrically connected in series to one of said fixed contact elements.

9. A switch as claimed in claim 1, further comprising a breaker section including an operating mechanism for automatically interrupting electric current when an excessively high current flows therethrough and also for interrupting electric current flow therethrough by manual operation of a handle.

10. A switch as claimed in claim 1, further comprising an electromagnet disposed alongside said electromagnetic driving device and including a movable iron core, and a transmitting member for transmitting movement of said movable iron core of said electromagnet to said second operating rod to control contacting movement of said movable contact by operating of said electromagnet.

11. A switch as claimed in claim 3, wherein said movable contact comprises a first and a second movable contact, said fixed contact comprises a first and a second fixed contact for individually contacting with said first and second movable contacts, respectively, said fixed contact element comprises a first and a second fixed contact element to which said first and second fixed contacts are individually secured, and said coil is electrically connected in series to one of said fixed contact elements.

12. A switch as claimed in claim 1, further comprising a current transformer disposed on one side of said electromagnetic driving device for detecting electric current flowing through said coil of said electromagnetic driving device, said coil of said electromagnetic driving device having a pair of lead wires connected to the opposite ends thereof, one of said lead wires extending through said current transformer.

13. A switch as claimed in claim 7, wherein said movable contact comprises a first and a second movable contact, said fixed contact comprises a first and a second fixed contact for individually contacting with said first and second movable contacts, respectively, said fixed contact element comprises a first and a second fixed contact element to which said first and second fixed contacts are individually secured, and said coil is electrically connected in series to one of said fixed contact elements.

14. A switch as claimed in claim 7, further comprising a current transformer disposed on one side of said electromagnetic driving device for detecting electric current flowing through said coil of said electromagnetic driving device, said coil of said electromagnetic driving device having a pair of lead wires connected to the opposite ends thereof, one of said lead wires extending through said current transformer.

* * * * *